US011649568B2

(12) United States Patent
Dilo

(10) Patent No.: US 11,649,568 B2
(45) Date of Patent: May 16, 2023

(54) FEED DEVICE OF A MACHINE FOR FORMING A NONWOVEN WEB

(71) Applicant: Oskar Dilo Maschinenfabrik KG, Eberbach (DE)

(72) Inventor: Johann Philipp Dilo, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 507 days.

(21) Appl. No.: 16/794,978

(22) Filed: Feb. 19, 2020

(65) Prior Publication Data

US 2020/0270786 A1 Aug. 27, 2020

(30) Foreign Application Priority Data

Feb. 21, 2019 (EP) ..... 19158485

(51) Int. Cl.

| | |
|---|---|
| ***D01G 15/40*** | (2006.01) |
| ***D01G 23/00*** | (2006.01) |
| *D01G 25/00* | (2006.01) |
| *D01G 9/00* | (2006.01) |
| *D01G 13/00* | (2006.01) |

(52) U.S. Cl.

CPC ..... *D01G 15/40* (2013.01); *D01G 23/00* (2013.01); *D01G 9/00* (2013.01); *D01G 13/00* (2013.01); *D01G 25/00* (2013.01)

(58) Field of Classification Search

CPC ..... D01G 15/40; D01G 15/42; D01G 15/44; D01G 21/00; D01G 23/00

See application file for complete search history.

(56) References Cited

U.S. PATENT DOCUMENTS

| | | | | |
|---|---|---|---|---|
| 151,840 A * | 6/1874 | Carlisle | D01H 5/72 | 19/157 |
| 389,133 A * | 9/1888 | Bates | D01H 5/72 | 19/157 |
| 1,637,139 A * | 7/1927 | Clow | D01G 15/70 | 19/160 |
| 2,725,599 A * | 12/1955 | Schorsch | D01G 15/42 | 19/65 R |
| 2,851,849 A * | 9/1958 | Merrill | D01G 15/42 | 57/252 |

(Continued)

FOREIGN PATENT DOCUMENTS

| | | |
|---|---|---|
| EP | 0 383 246 A2 | 8/1990 |
| EP | 2119817 A2 | 11/2009 |
| EP | 2 695 976 A1 | 2/2014 |

OTHER PUBLICATIONS

EP 19 15 8485 Search Report dated Aug. 2, 2019.

*Primary Examiner* — Shaun R Hurley
(74) *Attorney, Agent, or Firm* — Jansson Munger McKinley & Kirby Ltd.

(57) ABSTRACT

The feed device for feeding individualized fibers or fiber flocks to a transport device which includes a first feed segment and a second feed segment for feeding in a starting material. Each feed segment has its own feed roller and each feed roller is individually actuatable. The feed device also includes an opening roller, which cooperates with the feed rollers of the first and second feed segments to individualize the starting material into fibers or fiber flocks. The first and second feed segments are arranged a certain distance apart in a circumferential direction of the opening roller.

11 Claims, 3 Drawing Sheets

(56) References Cited

U.S. PATENT DOCUMENTS 5,121,523 A * 6/1992 Brutsch ..... D01G 23/04
222/64
9,187,852 B2 11/2015 Dilo

* cited by examiner

FEED DEVICE OF A MACHINE FOR FORMING A NONWOVEN WEB

FIELD OF THE INVENTION

The present invention relates to a feed device for feeding individualized fibers to a transport device, to a machine for forming a nonwoven web comprising such a feed device, and to a method for forming a card web or fiber fleece web.

For the production of fiber fleeces, fiber flocks are usually dispensed from a flock feeder to a transport device, which then conveys them in the form of a flock mat to a web-forming device such as a carding machine, to a fleece-former, or to a solidification machine such as a needling machine. It is usually desirable to produce a fiber fleece with a very high degree of uniformity. For this purpose, appropriate apparatus for intervention are present at various locations of the system. For example, the weight of the flock mat can be measured by a belt weigher, and on this basis the infeed rate of the web former can be adjusted. As an alternative to a highly uniform fleece, it is also desirable in many applications to form a fleece with a surface profile.

A feed device for delivering individualized fibers or fiber flocks to a transport device is known from US 2014/0034399 A1. This device comprises a plurality of feed segments arranged horizontally next to each other transversely to the transport direction. Each of these feed segments has its own feed roller, which cooperates with an opening roller of the feed device to individualize a starting material such as a fiber sliver or a strip of fiber fleece into fibers or fiber flocks. This makes it possible to effectively set and vary the quantity of fibers or fiber flocks dispensed by the feed device transversely to the transport direction of the transport device and thus to compensate for defective areas or irregularities in the flock mat or fleece web or to produce a predetermined transverse profile.

Each feed segment is supplied with an independent sliver or an independent fleece strip. These are supplied to the feed segment in the center relative to its width in the axial direction of the feed roller. As a result, the individualized fibers or fiber flocks are sometimes not distributed uniformly across the width of the associated feed segment, and thus more fibers or fiber flocks are transferred to the center than to the edges of each feed segment. Because each feed segment has its own feed roller, which therefore must be supported rotatably, space must be provided between the feed rollers of adjacent feed segments to accommodate the necessary bearings, which indicates that it is difficult to arrange the feed rollers directly adjacent to each other.

SUMMARY OF THE INVENTION

It is an object of the present invention to provide a feed device for delivering individualized fibers or fiber flocks to a transport device which make it possible to produce an especially uniform nonwoven web and to provide an especially high degree of flexibility with respect to the realization of the card web or fleece web to be produced.

According to an aspect of the invention, a feed device for delivering individualized fibers or fiber flocks to a transport device comprises at least one first feed segment and at least one second feed segment for delivering a starting material, wherein the first and second feed segments each comprise a feed roller. The feed device also comprises an opening roller, which cooperates with the feed rollers of the first and second feed segments to individualize the starting material into fibers or fiber flocks and to dispense the fibers or fiber flocks onto a transport device. The at least one first feed segment and the at least one second feed segment are arranged a certain distance apart in a circumferential direction of the opening roller.

As a result, the flexibility with respect to the formation of the material web to be produced is significantly increased. As a function of the offset between the first and second feed segments in an axial direction of the opening roller, various advantages can be obtained. These advantages can be combined in any way desired by providing additional feed segments, or any one of these advantages can also be realized by itself.

The fact that two feed segments are arranged a certain distance apart in a circumferential direction of the opening roller indicates that the feed rollers of the two feed segments are not aligned axially with respect to each other, but are instead distributed around the circumference of the opening roller in such a way that the axes of these feed rollers are parallel to each other and are arranged a predetermined distance apart around the circumference of the opening roller. It is preferred that the axes of these feed rollers, furthermore, be parallel to the axis of the opening roller. The feed rollers are preferably the same distance away from the axis of the opening roller in the radial direction of the opening roller, but this distance can also vary, if the dimensions of the rollers differ.

Because the first and second feed segments are arranged a certain distance apart in the circumferential direction of the opening roller, it is possible to arrange the feed segments close together in the axial direction of the opening roller and of the feed roller, so that the intermediate space between adjacent feed segments required for the support elements has no negative effect on the uniformity of the material web transversely to the transport direction. By overlapping the feed segments in the axial direction, the effects of the nonuniform distribution of the fibers or fiber flocks across the width of a feed segment can be counteracted. If the first and second feed segments are oriented with respect to each other without any offset in the axial direction of the opening roller, it is also possible to mix different fibers or to feed different fibers in alternation to the transport device.

Depending on the desired purpose and arrangement of the feed device in the nonwoven-forming process, the feed segments can deliver the fibers or fiber flocks to the transport device to form a new material web on the transport device, or they can deliver fibers or fiber flocks to an existing material web on the transport device being conveyed underneath the feed device. To cover all of the various possibilities in general, the term "material web" is used, which can be a fiber flock mat, a card web, or a fleece web.

The starting material is preferably a fiber sliver or a fiber fleece strip. The starting material supplied by the first feed segment can be different from the starting material supplied by the second feed segment. In particular, the fibers of the starting materials can differ with respect to at least one property. The at least one property of the fibers of the first and second starting materials in which the fibers differ is preferably selected from: the color of the fibers, the type of fiber, the material of the fibers, the diameter of the fibers, the length of the fibers, the treatment of the fibers, the cross-sectional shape of the fibers, and the roughness or the crimping of the fibers. Natural or synthetic fibers, for example, represent different types of fibers. Different fiber materials can be, for example, different natural fibers or different synthetic fibers. With respect to the fiber treatment, chemical treatments of the fibers can be provided, for example. The properties of the fibers then have corresponding effects on the properties of the material web formed from them. The same starting material, however, can also be supplied to all of the feed segments.

The feed rollers and the opening roller work together in an area where they face each other to individualize the starting material. The starting material is drawn in between the individual feed roller and the opening roller and is individualized into separate components such as individual fibers or fiber flocks. For this purpose the feed rollers and the opening roller usually comprise sets of teeth, which penetrate into the starting material and pull it apart to separate out the fibers or fiber flocks from the starting material. The cooperation between the feed rollers and the opening roller and their preferred embodiments are familiar to the skilled person.

The opening roller is driven by, for example, a servo motor. The opening roller is preferably configured to extend continuously in the direction transverse to the transport direction, but it can also be made up of several opening roller sections aligned axially with each other. It is also obvious that, in addition to the first and second feed segments, additional feed segments can also be provided certain distances apart from the first and second feed segments in the circumferential direction of the opening roller.

In order to be able to set the quantity of fibers or fiber flocks supplied by the first and second feed segments independently of each other, the feed rollers of the first and second feed segments are preferably actuatable individually, and thus independently from each other.

In a preferred embodiment, the first and second feed segments spaced apart in the circumferential direction are arranged without any offset from each other in an axial direction of the opening roller. The first and second feed segments are therefore arranged in a row in the circumferential direction. In addition, the opening roller of the feed device is arranged in such a way that its axis is transverse to a transport direction of the transport device, onto which the fibers or fiber flocks are dispensed. Fibers or fiber flocks of the starting material of the first and second feed segments are therefore transferred, transversely to the transport direction, to the same area of the transport device, because the first and second feed segments cooperate with the same section of the opening roller. If the two feed rollers of the first and second feed segments, furthermore, are actuatable independently of each other, a mixing ratio between the starting materials of the first and second feed segments can be set to any desired value. Thus it is possible to introduce different properties alternating with each other in the transport direction of the transport device and thus in the longitudinal direction of the material web or to combine fibers of different properties in the desired mixing ratio. The properties of the material web can thus be adapted in any way desired.

For example, the fibers of the different starting materials can have different colors, as a result of which a colored patterning of the material web can be produced. Above all, however, it is possible to use fibers of different types, of different materials, and/or of different dimensions, the mixing ratio of which can be regulated in any way desired to influence the mechanical properties of the material web.

In one embodiment, the first and second feed segments are preferably arranged with an offset from each other in the axial direction of the opening roller. The feed segments can be completely offset from each other; i.e., each feed segment cooperates with a section of the lateral surface of the opening roller with which no other feed segment cooperates. Because of their spacing in the circumferential direction, however, the feed segments can be closer together in the axial direction, so that, across the width of the material web transverse to the transport direction, there will be no section of the lateral surface of the opening roller which does not cooperate with one of the feed segments.

The feed segments, however, can also have a smaller offset from each other, so that the sections of the lateral surface of the opening roller with which the feed segments cooperate partially overlap. This is advantageous especially in cases where the fibers or fiber flocks are not dispensed uniformly across the width of a feed segment and thus a smaller quantity of fibers is present in the edge area of each feed segment. By allowing the sections of the lateral surface of the opening roller with which the feed segments cooperate overlap, the nonuniform delivery of fibers in these edge areas is counteracted.

It is also preferred that the feed device comprise at least one additional feed segment, which is aligned in the axial direction with the first or the second feed segment. Several additional feed segments can also be provided, at least one of these additional feed segments (third feed segment) being aligned axially with the first feed segment, and at least one additional feed segment (fourth feed segment) being aligned axially with the second feed segment. The axial direction refers here to the feed rollers. As a result, several feed segments are arranged horizontally next to each other in the axial direction. The feed segments arranged axially next to each other can produce a profile in the transverse direction of the material web or equalize this profile, if desired. Because, in addition, at least the first and second feed segments are a certain distance apart in the circumferential direction of the opening roller, the advantages of the arrangement of feed segments in the axial direction and in the circumferential direction can be combined, and the flexibility in the production of the material web is further increased.

To produce or to equalize a transverse profile, furthermore, it is preferred that the feed segments axially aligned with each other be individually actuatable. This is preferably achieved in that each of the axially aligned feed segments comprises its own feed roller.

Because several rows of axially oriented feed segments can be distributed around the circumference of the opening roller, the axially adjacent feed segments of a first row can be arranged a certain distance apart in the axial direction, so that there is sufficient room between them for the support of the feed rollers. A second row of axially adjacent feed segments is then arranged a certain distance apart in the circumferential direction, wherein the feed segments of the two rows are offset from each other in such a way that the feed segments of the second row cooperate with the sections of the surface of the opening roller with which the first row does not cooperate. As a result, it is ensured that fibers or fiber flocks are dispensed over the entire working width. This idea can be extended to any desired number of rows of axially aligned feed segments arranged a certain distance apart in the circumferential direction.

A nonwoven-forming machine for forming a material web preferably comprises a transport device for conveying the material web in a transport direction and at least one previously described feed device for delivering individualized fibers or fiber flocks to the transport device. In this way, a nonwoven-forming machine is provided which enjoys the previously described advantages of the feed device according to the invention.

The nonwoven-forming machine can comprise a device for forming a material web, e.g., a flock feeder, which is arranged upstream of the at least one feed device, relative to the transport direction of the transport device, in which case the at least one feed device then adds additional fibers or fiber flocks to the material web. Such a device can also be omitted, however, and then the at least one feed device will itself form the material web on the transport device.

The flexibility and variety available for the formation of the material web can be increased even more by providing the nonwoven-forming machine with two of the previously described feed devices for feeding individualized fibers or fiber flocks to the transport device. The two feed devices then preferably comprise feed segments with different arrangements. Thus, for example, it is possible for the feed segments of one feed device to be arranged without any offset from each other in the axial direction and to form several axially aligned rows of feed segments, distributed around the circumference of the opening roller. The feed segments of the one feed device can then be arranged with an offset in the axial direction of the opening roller from the feed segments of the other feed device in order to dispense fibers or fiber flocks to the transport device over the entire working width of the nonwoven-forming machine.

The two feed devices are preferably arranged one behind the other in the transport direction, so that the axes of the opening rollers of the two feed devices are parallel to each other.

A method for forming a material web by a feed device with a first and a second feed segment and an opening roller, wherein the first and second feed segments are arranged a certain distance apart in the circumferential direction of the opening roller includes the steps of (1) providing a first starting material of fibers at the first feed segment of the feed device; (2) providing a second starting material of fibers at the second feed segment, wherein at least one property of the fibers of the first starting material differs from the corresponding property of the fibers of the second starting material; (3) feeding the first and second starting materials to the opening roller; (4) individualizing the delivered starting material by the opening roller to form individualized fibers or fiber flocks from the delivered starting material; and (5) scattering or dispensing the individualized fibers or fiber flocks onto a transport device.

In this way it is possible to dispense fibers with different properties in the transport direction and thus in the longitudinal direction of the material web and thus effectively to influence the properties of the material web and to vary them. As previously described, the at least one property of the fibers of the first and second starting materials with respect to which the fibers differ can be selected from: the color of the fibers, the type of fiber, the fiber material, the fiber diameter, the fiber length, the fiber treatment, the cross-sectional shape of the fibers, and the roughness or crimping of the fibers.

It is especially preferred that the first and second feed segments be arranged in the circumferential direction of the opening roller without any offset from each other in the axial direction of the opening roller, and the method includes feeding the first and second starting materials to the opening roller and varying the delivered quantity of the first and/or of the second starting material and thus setting a mixing ratio between the first and second starting materials, wherein the mixing ratio is between 0:1 and 1:0, preferably between 0.01:1 and 1:0.01.

This makes it possible to arrange fibers or fiber flocks of the first and second starting materials in alternation in the transport direction and thus in the longitudinal direction of the material web (mixing ratio, 0:1 or 1:0) or to set the mixing ratio to any desired value between 0:1 and 1:0, preferably in the range of 0.01:1 to 1:0.01. The nonwoven-forming machine is able to produce a material web with a patterning in the longitudinal direction or to produce areas with different mechanical properties in the longitudinal direction of the material web.

Finally, the method preferably comprises the formation of a strip of fibers or fiber flocks on the transport device, in that the mixing ratio between the fibers or fiber flocks of the first starting material and the fibers or fiber flocks of the second starting material changes along the transport direction.

Materials which are required only in certain areas of the material web or of the end product can therefore be introduced only locally, which serves to conserve material. For example, specific areas can be reinforced by the addition of carbon fibers, whereas areas of the material web which do not require any reinforcement in the end product can contain no carbon fibers. Thus costs can be reduced, whereas at the same time the given requirements on the product to be obtained can be taken optimally into account.

DETAILED DESCRIPTION OF SPECIFIC EMBODIMENTS

Figure 1:
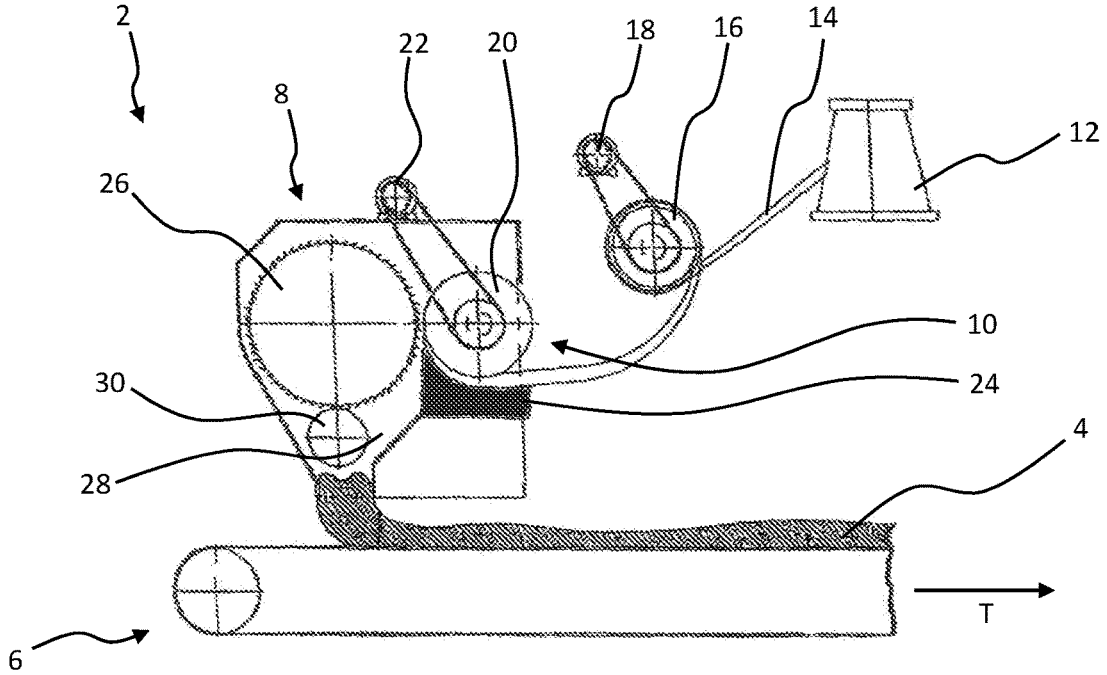
FIG. 1 is a schematic side view of a nonwoven-forming machine.

FIG. 1 shows a schematic side view of a nonwoven-forming machine 2. Nonwoven-forming machine 2 is set up to form a material web 4, in particular a card web or a fleece web. Nonwoven-forming machine 2 comprises a transport device 6 for conveying material web 4 in a transport direction T and at least one feed device 8 for delivering individualized fibers or fiber flocks to transport device 6. In the embodiment shown, feed device 8 forms a new material web 4. In an alternative embodiment, material web 4, e.g., any desired intermediate fleece product, can already be arranged on transport device 6 upstream of feed device 8 relative to transport direction T, and nonwoven-forming machine 2 distributes additional fibers or fiber flocks onto this material web to form a uniform material web 4 or a material web 4 with a surface profile.

Transport device 6 preferably moves continuously in transport direction T. Transport device 6 can be configured as an endless conveyor belt, preferably as a sieve belt with bottom suction. The speed of transport device 6 is preferably in the range of between 0.2 and 20 m/min, more preferably in the range of between 0.05 and 10 m/min.

Feed device 8 comprises a plurality of feed segments 10 (110, 210, 310 in FIGS. 2-4); to explain the general structure and general function of these segments, only one feed segment is shown in the side view of FIG. 1. One or more measuring devices (not shown), which measure the weight per unit area of material web 4 across the width extending transversely to the transport direction T, can be arranged upstream and/or downstream of feed device 8 in the manner familiar to the skilled person. On the basis of the data obtained from these measuring devices, the transverse profile can be determined, and on the basis of the movement of transport device 6 in transport direction T, the longitudinal profile of material web 4 can also be determined.

The formed material web 4 can be sent by transport device 6 to various alternative processing steps. In a first alternative, material web 4 is sent to a card-forming device, preferably a carding machine, and is equalized there. In a second alternative, the material web is sent directly to a fleece former, e.g., an aerodynamic fleece former. In a third variant, the material web is individualized again before further processing. In a fourth alternative, the material web is sent directly to a solidification machine e.g., a needling machine.

Figure 2:
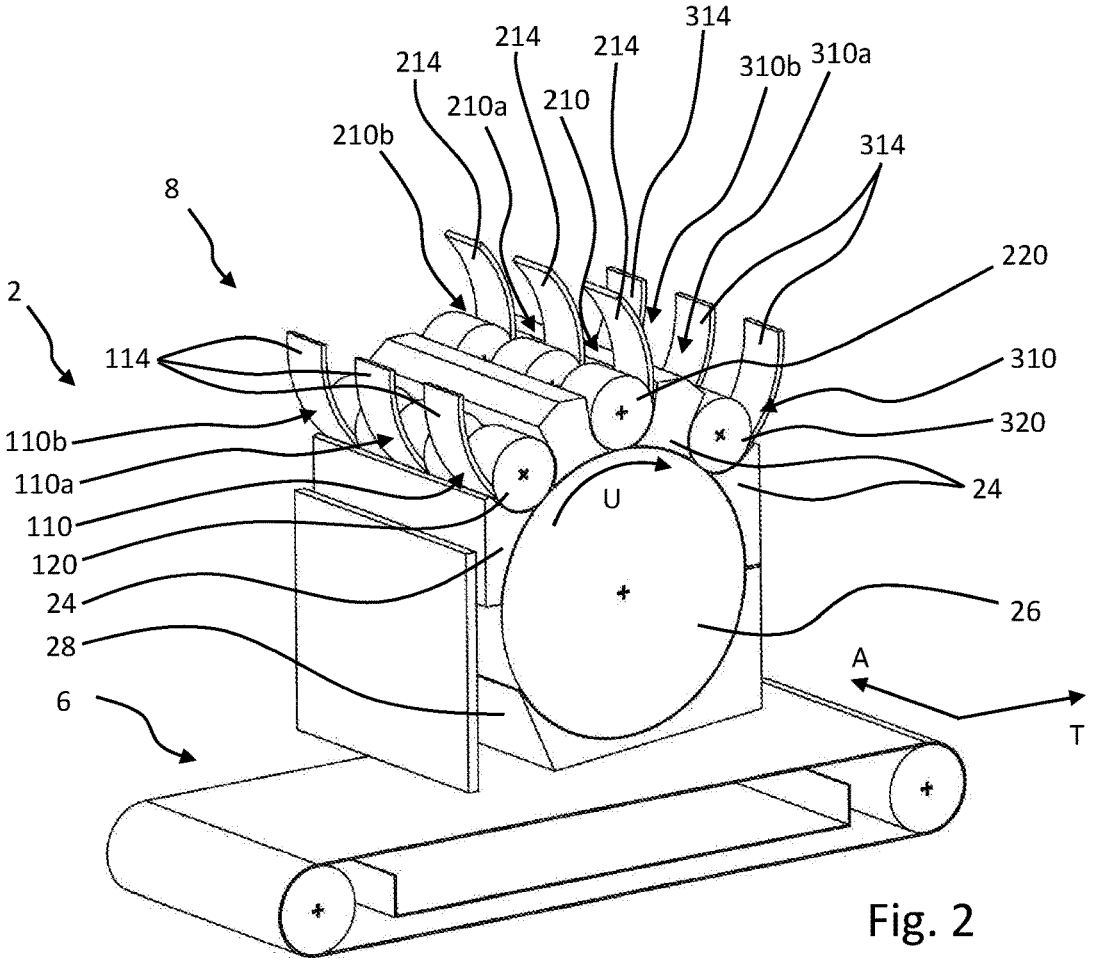
FIG. 2 is a perspective view of one embodiment of a nonwoven-forming machine including a feed device according to the invention.
Figure 3:
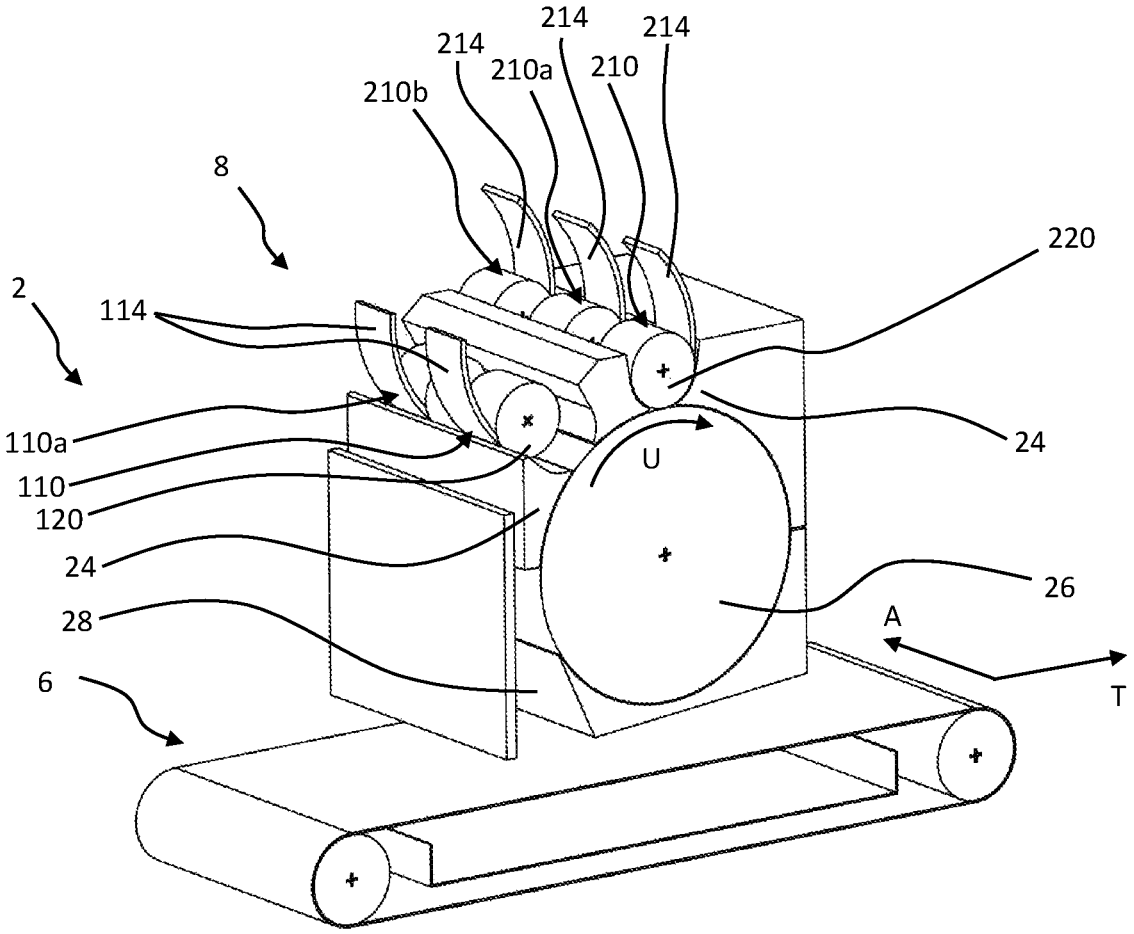
FIG. 3 is a perspective view of an alternative embodiment of a nonwoven-forming machine including a feed device according to the invention.
Figure 4:
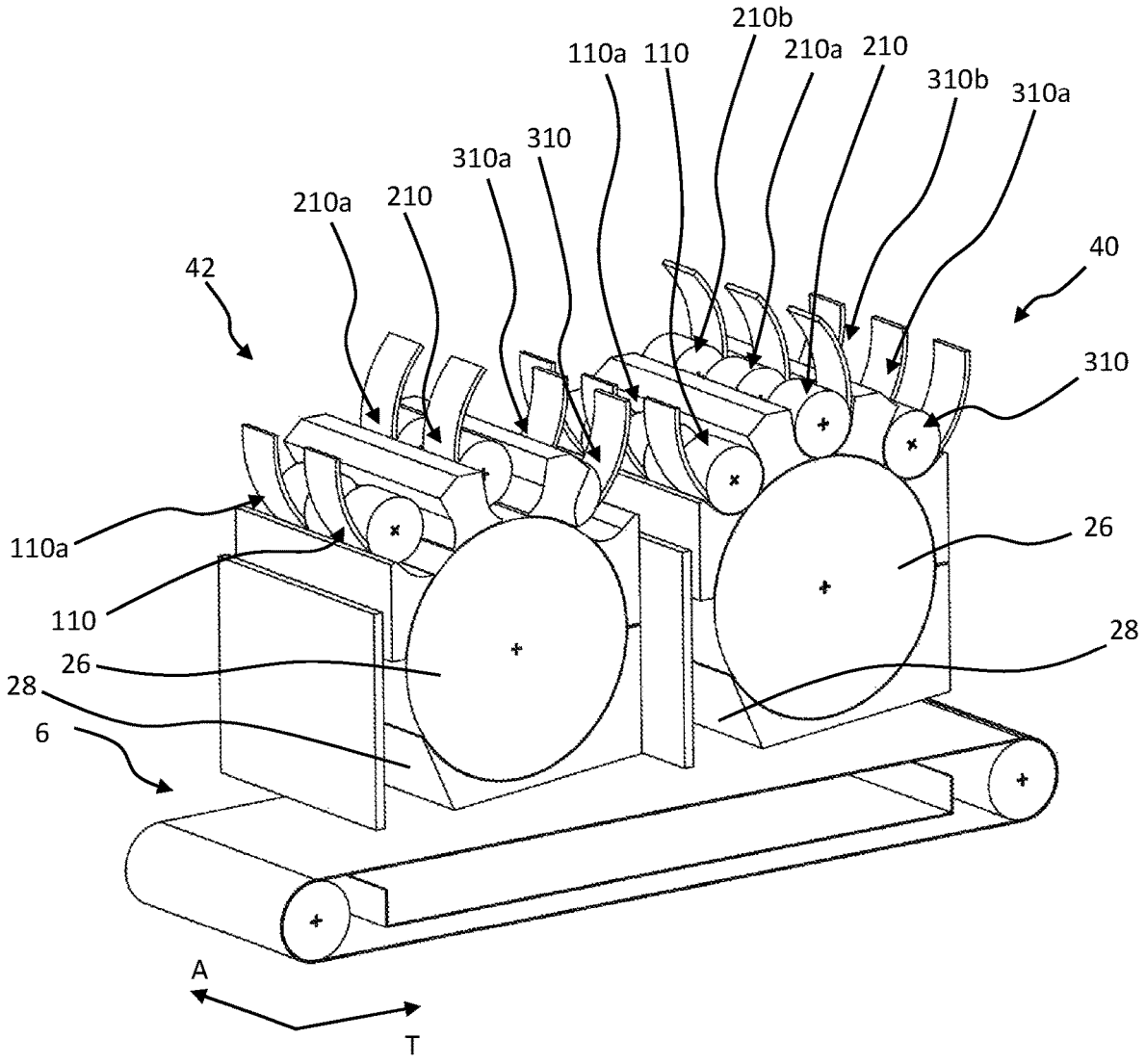
FIG. 4 is a perspective view of another alternative embodiment of a nonwoven-forming machine including a feed device according to the invention.

A dispensing device 12 for the storage and controlled dispensing of a starting material 14, e.g., a fiber sliver or a fleece strip (as shown in FIGS. 2-4), is assigned to each feed segment 10 of feed device 8. In the exemplary embodiment shown, dispensing device 12 is configured as a spool, but it could also be provided in the form of a sliver can or the like. The starting material proceeds from dispensing device 12 to a preferably rubberized storage roller 16, which extends transversely to transport direction T and horizontally over preferably the entire width of feed device 8. A turn of a starting material 14 provided by dispensing device 12 is wrapped around storage roller 16. Storage roller 16 is driven, preferably by a servo motor 18 and also preferably continuously at a relatively slow speed. In certain embodiments, storage roller 16 could also be omitted.

Storage roller 16 can be configured as a one-piece unit. If several feed segments are arranged horizontally next to each other transversely to transport direction T (perpendicular to the plane of the drawing in FIG. 1), the storage roller can accept several strands of starting material 14 simultaneously for these feed segments 10. It is also possible, however, for there to be a separate storage roller 16 for each feed segment 10.

Feed segment 10 comprises a rotating feed roller 20, to which the starting material 14 is fed. In the embodiment shown, feed roller 20 pulls off starting material 14 provided by the associated dispensing device 12, either via the intermediate agency of storage roller 16 or directly. Feed rollers 20 of the plurality of feed segments 10 are preferably actuatable individually. For this purpose, each feed roller 20 is preferably driven by a servo motor 22. Each feed roller 20 also comprises a set of projecting teeth (not shown) for drawing in the starting material 14.

Starting material 14 carried along by the feed rollers 20 is preferably sent via a trough 24 to an opening roller 26. Opening roller 26 can be configured as a one-piece unit and extend transversely to transport direction T over the entire width of feed device 8, preferably over the entire width of material web 4 to be formed. Opening roller 26, however, could also comprise individual segments, which are oriented axially with respect to each other transversely to transport direction T.

Opening roller 26 can be driven in the same rotational direction as feed roller 20. Opening roller 26 also comprises a set of projecting teeth. For example, each feed roller 20 comprises a set of teeth which project backwards with respect to the rotational direction of the associated feed roller 20, and opening roller 26 comprises a set of teeth projecting forwards with respect to the rotational direction of opening roller 26. The sets of teeth of feed rollers 20 and of opening roller 26, however, can also be configured in some other conventional manner.

Opening roller 26 cooperates with feed rollers 20 to individualize starting material 14. In particular, opening roller 26 and feed rollers 20 are especially effective at opening up the twisted or compacted starting material 14 of a fiber sliver or a fiber fleece strip, so that loose flocks or even fine fibers are separated. These drop into an appropriate discharge shaft 28 and fall from there onto transport device 6. In addition, an optional cleaning roller 30 can be provided, which strips off the fibers or fiber flocks adhering to opening roller 26 from the roller, so that these, too, can drop into discharge shaft 28.

FIG. 2 shows a schematic view, in perspective, of a first embodiment of a nonwoven-forming machine 2 comprising a feed device 8 according to the invention. As previously described, feed device 8 serves to feed individualized fibers or fiber flocks to transport device 6 and comprises an opening roller 26 as well as a plurality of feed segments 110, 210, 310, which can have a configuration similar to that of feed segment 10 described on the basis of FIG. 1. In particular, feed device 8 comprises at least one first feed segment 110 and one second feed segment 210. The first and second feed segments 110, 210 are a certain distance apart in the circumferential direction U of opening roller 26. In the embodiment shown, an optional third feed segment 310 is also arranged a certain distance away from the first and second feed segments 110, 210 in the circumferential direction U of opening roller 26.

Each feed segment 110, 210, 310 is fed with a strand of twisted or compacted starting material 114, 214, 314. Alternatively, each feed segment 110, 210, 310 can also be fed with a plurality of strands of the starting material 114, 214, 314, e.g., with two or three strands.

The first feed segment 110 comprises a feed roller 120; the second feed segment 210 comprises a feed roller 220; and the third feed segment 310 comprises a third feed roller 320. Opening roller 26 cooperates with the feed rollers 120, 220, 320 to individualize the associated starting material 114, 214, 314. For this purpose, the feed segments 110, 210, 310 are arranged on the circumference of the opening roller.

Because, as shown here, the first and second feed segments 110, 210 and the optional third feed segment 310 are spaced in the circumferential direction U of the opening roller 26, new possibilities for arranging the plurality of feed segments of a feed device 8 and new possible applications for nonwoven-forming machine 2 as such are obtained.

In the embodiment according to FIG. 2, first and second feed segments 110, 210 and the third feed segment 310 are aligned with respect to each other without any offset in the axial direction A of the opening roller 26. Axial direction A of opening roller 26 is parallel to the rotational axis of opening roller 26 and thus, in the preferred embodiment, is transverse to the transport direction T. Because the first, second and third feed segments 110, 210, 310 are aligned with each other in axial direction A, they form a row of feed segments 110, 210, 310, arranged one behind another in the circumferential direction U. The fibers or fiber flocks provided by the first, second, and third feed segments 110, 210, 310 arranged to form a row of feed segments 110, 210, 310, cooperate with opening roller 26 to form a strip of flocks or fibers on transport device 6.

Feed segments 110, 210, 310 of such a row can be supplied with starting materials 114, 214, 314 which differ from each other with respect to at least one property. As a result, the properties of the material web 4 can in turn be effectively adjusted in the longitudinal direction of the material web. For example, a first starting material 114 is supplied to the first feed segment 110; a second starting material 214 is supplied to the second feed segment 210; and a third starting material 314 is supplied to the optional third feed segment 310. At least one of the properties of the fibers of first, second and third starting materials 114, 214, 314 can differ from the corresponding property of the fibers of the other starting materials 114, 214, 314. The at least one property of the fibers of first, second, and third starting materials 114, 214, 314 by which the fibers differ is preferably selected from the color of the fibers, the type of fiber, the fiber material, the fiber size, or the fiber treatment, as previously described.

Once first, second, and third starting materials 114, 214, 314 have been supplied to feed segments 110, 210, 310 arranged in a row one behind the other in the circumferential direction U of opening roller 26, it is possible to vary the supplied quantity of the first and/or second and/or third starting material 114, 214, 314 independently of each other. This can be achieved in particular in that feed rollers 120, 220, 320 of the first, second, and third feed segments can be actuated individually. As a result, each feed roller 120, 220, 320 can be driven or not driven, as a result of which the feed of associated starting material 114, 214, 314 can be turned on or off. In addition, the rotational speed of individual feed rollers 120, 220, 320 can be regulated, as a result of which the quantity of the associated starting material 114, 214, 314 which has been supplied can be regulated.

The end result is that any desired mixing ratio between the first, second, and third starting materials 114, 214, 314 can be set. In particular, the mixing ratio can also be adjusted during operation.

One of starting materials 114, 214, 314 or any desired mixtures of one of starting materials 114, 214, 314 with one or both of the other starting materials, furthermore, can be delivered to transport device 6 so that they alternate in the transport direction T. As a result, it is possible, for example, to produce colored patterns in material web 4. It is also possible, however, to influence the mechanical properties of the material web in that, for example, fibers of different types, of different materials, or of different sizes can be delivered.

It is also preferred that feed device 8 comprise at least one additional feed segment which is aligned in axial direction A with the first or second feed segment 110, 210. As a result, a row of feed segments arranged next to each other in the axial direction A is obtained. The additional feed segments are characterized in FIGS. 2-4 by the addition of "a" or "b". The additional feed segments are optional, and an additional feed segment or a plurality of additional feed segments can be assigned to each of the first, second and third feed segments 110, 210, 310. The additional feed segments are preferably configured in a manner similar to that of the previously described feed segments 10, 110, 210, 310, unless otherwise described.

In the embodiment illustrated here, feed device 8 comprises the additional feed segments 110*a* and 110*b*, which are aligned axially with first feed segment 110; additional feed segments 210*a* and 210*b*, which are aligned axially with second feed segment 210; and additional feed segments 310*a* and 310*b*, which are axially aligned with third feed segment 310. It is preferred that each of the additional feed segments 110*a*, 110*b*, 210*a*, 210*b*, 310*a*, 310*b* be individually actuatable. For this purpose, each feed segment 110, 110*a*, 110*b*, 210, 210*a*, 210*b*, 310, 310*a*, 310*b* of the feed device preferably comprises its own feed roller 120, 220, 320, as a result of which the feed of the starting material 114, 214, 314 to each feed segment can be individually regulated.

According to FIG. 2, additional feed segments 110*a*, 210*a*, 310*a* are also aligned with each other in the circumferential direction U of the opening roller 26 without any offset in the axial direction A; and additional feed segments 110*b*, 210*b*, 310*b* are correspondingly aligned with respect to each other in the circumferential direction U so that in each case an additional row of feed segments 110*a*, 210*a*, 310*a* and 110*b*, 210*b*, 310*b* arranged one behind the other is formed.

Feed device 8 therefore comprises, in all, nine feed segments 110, 110*a*, 110*b*; 210, 210*a*, 210*b*; 310, 310*a*, 310*b*, which are arranged in three rows, one behind the other, in the circumferential direction U and in three rows adjacent to each other in the axial direction A.

Feed segments 110, 110*a*, 110*b*; 210, 210*a*, 210*b*; 310, 310*a*, 310*b* arranged adjacent to each other in the axial direction A can be operated synchronously, so that a newly formed material web 4 has a substantially homogeneous configuration transversely to transport direction T. These feed segments, however, can also be operated independently of each other to produce a surface profile transverse to the transport direction T of material web 4, or to compensate for an undesirable surface profile in a material web already present on transport device 6.

Feed segments 110, 110*a*, 110*b*; 210, 210*a*, 210*b*; 310, 310*a*, 310*b* arranged adjacent to each other in the axial direction A can each be fed with a starting material 114, 214, 314 which corresponds to the starting material 114, 214, 314 of the other feed segments of the axial row. It is also possible, however, that each of these feed segments could be fed with a starting material 114, 214, 314 whose fibers differ in at least one property from the corresponding property of the fibers of the other starting materials 114, 214, 214, as previously described.

The three rows of feed segments arranged in a row one behind the other in the circumferential direction U are spaced a certain distance apart in the axial direction A. A minimum distance between feed segments axially adjacent to each other is determined by the amount of space required to accommodate the bearings of the axial ends of the associated feed rollers in feed device 8. This has led to the situation that the fiber distribution transverse to the transport direction T on transport device 6 is nonuniform even when the feed segments adjacent to each other in the axial direction A are operated synchronously. This effect is amplified even more by the fact that the starting material is usually supplied centrally to the associated feed segment, and the fiber distribution therefore decreases across the width of a feed segment toward the edges of that feed segment.

FIG. 3 therefore shows an embodiment of the feed device 8 or of the nonwoven-forming machine 2 in which the feed segments are arranged to counteract this effect. What was said above applies analogously here to the nonwoven-forming machine 2, to the feed device 8, and to its feed segments 110, 110*a*, 210, 210*a*, 210*b* with the difference that the feed segments have a different arrangement relative to each other.

As previously described, the first and second feed segments 110, 210 are arranged again a certain distance apart from each other in the circumferential direction U of the opening roller 26. Optionally, another feed segment 110*a* is aligned with the first feed segment 110, and two additional feed segments 210*a* and 210*b* are aligned with the second feed segment 210. More additional feed segments or fewer additional feed segments can be provided, and, in analogy to FIG. 2, a third feed segment 310 with or without additional feed segments assigned to it can also be present.

The first and second feed segments 110, 210 according to FIG. 3, however, are arranged with an offset from each other in the axial direction A of the opening roller 26. The first and second feed segments 110, 210 therefore do not form a row of feed segments arranged one behind the other in the circumferential direction U without an offset in the axial direction A. The additional feed segments 110*a*, 210*a*, 210*b* do not form any such rows either.

It is preferred that the working areas of the first and second feed segments 110, 210 overlap in the circumferential direction U. That is, a portion of the area of the lateral surface of the opening roller 26 which cooperates with the feed roller 120 of the first feed segment 110 simultaneously cooperates with the feed roller 220 of the second feed segment 210. The overlapping of the working areas of the first and second feed segments 110, 210 have the effect that fibers or fiber flocks of both the first and second feed segments 110, 210 are distributed onto the transport device 6 in the area of this overlap. The smaller quantity of fibers present in the edge area of each individual feed segment 110, 210 can thus be compensated.

In the embodiment according to FIG. 3, the feed segments 110, 110*a*, 210, 210*a*, 210*b* are arranged in two rows of axially adjacent feed segments 110, 110*a* and 210, 210*a*, 210*b*. The feed segments 110, 110*a* of the one row are offset in the axial direction from the feed segments 210, 210*a*, 210*b* of the other row. It is preferred that, as a result of this arrangement, there be no areas in the axial direction of opening roller 26 in which the opening roller does not cooperate with at least one feed roller of the feed segments. More precisely, first feed segment 110 is arranged axially in such a way that its working area overlaps the working areas of second feed segment 210 and of additional feed segment 210*a*. In spite of the axial spacing between second feed segment 210 and additional feed segment 210*a*, there is therefore no area on the transport device corresponding to this axial spacing onto which no fibers or fiber flocks are distributed. Correspondingly, additional feed segment 110*a* is arranged in the axial direction in such a way that its working area overlaps the working areas of additional feed segment 210*a* and of additional feed segment 210*b*. This arrangement can be scaled in any way desired both in circumferential direction U and in axial direction A.

In this embodiment, however, it is possible to only a limited extent to set a mixing ratio between fibers of different properties or to feed fibers or fiber flocks of different properties in the transport direction T of material web 4, as described with reference to FIG. 2.

FIG. 4 therefore shows an embodiment of a nonwoven-forming machine 2 which combines the advantages of the previously described embodiments according to FIGS. 2 and 3. Nonwoven-forming machine 2 according to FIG. 4 comprises a first feed device 40 and a second feed device 42 for delivering individualized fibers or fiber flocks to transport device 6. The two feed devices 4042 are arranged one behind the other in transport direction T, so that the axes of opening rollers 26 of the two feed devices 40 42 are parallel to each other.

First feed device 40 corresponds to feed device 8 according to FIG. 2. The corresponding explanations apply here as well.

Second feed device 42 corresponds substantially to feed device 8 according to FIG. 2, wherein it comprises only two rows of feed segments 110, 210, 310 and 110*a*, 210*a*, 310*a*, arranged one behind the other in the circumferential direction U. More precisely, the first, the second, and the third feed segment 110, 210, 310 of second feed device 42 form a first row of feed segments arranged one behind the other, and the additional feed segments 110*a*, 210*a*, 310*a* of second feed device 42 form a second row of feed segments arranged on behind the other, wherein the first and the second rows extend in circumferential direction U of opening roller 26.

As described above, feed device 40 comprises three rows of feed segments arranged on behind the other in circumferential direction U of opening roller 26, namely, one row of feed segments 110, 210, 310; another row consisting of the feed segments 110*a*, 210*a*, 310*a*; and an additional row consisting of the feed segments 110*b*, 210*b*, 310*b*.

Both in the case of first feed device 40 and in the case of second feed device 42, each row of feed segments arranged one behind the other in the circumferential direction U makes it possible to supply different starting materials within one row, as a result of which it is possible to dispense different fibers or fiber flocks in any desired mixing ratio.

In order, furthermore, to counteract the disadvantages of intermediate spaces in the axial direction between the rows of feed segments arranged on behind the other, that is, between two feed segments arranged next to each other in the axial direction, the rows of feed segments of first feed device 40 arranged one behind the other are offset in the axial direction A of opening roller 26 from the rows of feed segments of second feed device 42 arranged one behind the other.

In this way, fibers or fiber flocks are supplied by first feed device 40 to areas of transport device 6 onto which second feed device 42 is, as a result of its structural design, unable to supply any fibers or fiber flocks or is able to supply only a few of them. As a result, it is possible to achieve an equalization or to create a profile over the entire width of a material web 4 transversely to transport direction T, whereas the ability to supply a variety of different starting materials and to deliver them in any desired mixing ratios can be exploited at the same time.

It is obvious that the skilled person, within the scope of the claimed teaching, can adapt the number of feed segments of a feed device both in the circumferential direction and in the axial direction, as well as the number of feed devices in a nonwoven-forming machine in any way desired to satisfy the given requirements and desires. As many feed segments as desired can be arranged next to each other in a row in the axial direction, and as many feed segments as desired can be arranged around the opening roller in the circumferential direction of the roller.

The invention claimed is:

1. A feed device for feeding individualized fibers or fiber flocks to a transport device, the feed device comprising:

a plurality of feed segments at least comprising a first feed segment and a second feed segment, wherein the first feed segment has a first feed roller to feed a first fiber sliver of fiber fleece strip and the second feed segment has a second feed roller to feed a second fiber sliver or fiber fleece strip, and wherein the first and second feed rollers are individually actuatable; and an opening roller, which cooperates with the first feed roller to individualize the first fiber sliver or fiber fleece strip at the first feed segment into fibers or fiber flocks and which cooperates with the second feed roller to individualize the second fiber sliver or fiber fleece strip at the second feed segment into fibers or fiber flocks;

wherein the first and second feed segments are arranged a certain distance apart in a circumferential direction of the opening roller.

2. The feed device of claim 1 wherein the first and second feed segments are aligned with each other in the circumferential direction without any offset in an axial direction of the opening roller.

3. The feed device of claim 1 wherein the first and second feed segments are arranged with an offset from each other in an axial direction of the opening roller.

4. The feed device of claim 1 further comprising a third feed segment, which is aligned in an axial direction of the opening roller with the first feed segment.

5. The feed device of claim 4 further comprising a fourth feed segment, which is aligned in an axial direction of the opening roller with the second feed segment.

6. The feed device of claim 5 wherein the third and fourth feed segments comprise third and fourth feed rollers which are individually actuatable.

7. The feed device of claim 4 wherein the third feed segment comprises a third feed roller which is individually actuatable.

8. A nonwoven-forming machine for forming a material web, the nonwoven-forming machine comprising:

a transport device conveyed in a transport direction; and a first feed device for scattering individualized fibers or fiber flocks onto the transport device, the first feed device comprising:

a plurality of feed segments at least comprising a first feed segment and a second feed segment, wherein the first feed segment has a first feed roller to feed a first fiber sliver or fiber fleece strip and the second feed segment has a second feed roller to feed a second fiber sliver or fiber fleece strip, and wherein the first and second feed rollers are individually actuatable; and an opening roller, which cooperates with the first feed roller to individualize the first fiber sliver or fiber fleece strip at the first feed segment into fibers or fiber flocks and which cooperates with the second feed roller to individualize the second fiber sliver or fiber fleece strip at the second feed segment into fibers or fiber flocks;

wherein the first and second feed segments are arranged a certain distance apart in a circumferential direction of the opening roller.

9. The nonwoven-forming machine of claim 8 further comprising a second feed device, the second feed device comprising:

a plurality of feed segments at least comprising another first feed segment and another second feed segment, wherein the other first feed segment has another first feed roller to feed another first fiber sliver or fiber fleece strip and the other second feed segment has another second feed roller to feed another second fiber sliver or fiber fleece strip; and a second opening roller, which cooperates with the other first feed roller to individualize the other first fiber sliver or fiber fleece strip at the other first feed segment into fibers or fiber flocks and which cooperates with the other second feed roller to individualize the other second fiber sliver of fiber fleece strip at the other second feed segment into fibers or fiber flocks.

10. The nonwoven-forming machine of claim 9 wherein the first and second feed devices are arranged one behind the other in the transport direction, and wherein axes of the first and second opening rollers of the first and second feed devices are parallel to each other.

11. The nonwoven-forming machine of claim 9 wherein the first feed segment and the second feed segment of the first feed device are offset in an axial direction of the first opening roller from the other first feed segment and second feed segment of the second feed device.

* * * * *